US006123143A

United States Patent [19]

Insalaco

[11] Patent Number: 6,123,143

[45] Date of Patent: Sep. 26, 2000

[54] HEAT EXCHANGER COMBINATION MOUNTING BRACKET AND INLET/OUTLET BLOCK WITH LOCKING SLEEVE

[75] Inventor: Jeffrey Lee Insalaco, Brandon, Miss.

[73] Assignee: Norsk Hydro, Oslo, Norway

[21] Appl. No.: 09/193,432

[22] Filed: Nov. 17, 1998

[51] Int. Cl.[7] ..... F28F 9/007

[52] U.S. Cl. ..... 165/67; 165/79; 165/178

[58] Field of Search ..... 165/67, 79, 178

[56] References Cited

U.S. PATENT DOCUMENTS

| | | | |
|---|---|---|---|
| 2,310,927 | 2/1943 | Bay . | |
| 4,130,932 | 12/1978 | Epmeier . | |
| 4,597,687 | 7/1986 | Colas . | |
| 5,069,275 | 12/1991 | Suzuki et al. . | |
| 5,205,349 | 4/1993 | Nagao et al. | 165/67 |
| 5,240,068 | 8/1993 | Tokutake | 165/67 |
| 5,407,161 | 4/1995 | Mulkeran . | |
| 5,429,182 | 7/1995 | Hanafusa . | |
| 5,441,100 | 8/1995 | Ueda . | |
| 5,685,364 | 11/1997 | Harris | 165/67 |
| 5,697,431 | 12/1997 | Nagasaka | 165/67 X |
| 5,711,370 | 1/1998 | Tanaka | 165/178 |

FOREIGN PATENT DOCUMENTS

| | | | |
|---|---|---|---|
| 229696 | 8/1994 | Japan | 165/178 |

*Primary Examiner*—Leonard Leo

*Attorney, Agent, or Firm*—Gary M. Hartman; Domenica N. S. Hartman

[57] ABSTRACT

An automotive heat exchanger that includes a manifold (12) and a mounting block (10) attached to the manifold (12) and over an opening (30) in the wall of the manifold (12). The mounting block (10) has a flange portion (16) with a surface (18) that engages approximately half of the outer perimeter of the manifold (12). The block (10) also includes means (20, 24) for securing the heat exchanger to an automobile (14), and an inlet/outlet port (26) extending through the block (10) and in fluidic communication with the opening (30) in the wall of the manifold (12). Grooves (19) are preferably present in the surface (18) of the flange portion (16) of the block (10), two of which engage raised portions (23) on the perimeter of the manifold (12) in order to aid in securing the block (10) to the manifold (12). The remaining grooves (19) provide reservoirs between the block (10) and manifold (12) for braze material (21) that metallurgically bonds the block (10) to the manifold (12). A sleeve (28) is preferably disposed partially within the inlet/outlet port (26) and partially within the opening (30) in the manifold (12), so as to provide a leak-free joint between the block (10) and manifold (12).

9 Claims, 3 Drawing Sheets

HEAT EXCHANGER COMBINATION MOUNTING BRACKET AND INLET/OUTLET BLOCK WITH LOCKING SLEEVE

BACKGROUND OF THE INVENTION

1. Field of the Invention

The present invention generally relates to heat exchanger construction, assembly and installation methods. More particularly, this invention relates to a bracket for mounting a heat exchanger to an automobile, wherein the bracket includes an inlet/outlet port to which a supply or return pipe is connected to the heat exchanger, and optionally includes a sleeve within the inlet/outlet port that aids in securing the bracket to the heat exchanger.

2. Description of the Prior Art

Heat exchangers for automotive applications typically have tubes interconnected between a pair of manifolds, headers or tanks. Automotive heat exchangers require some type of mounting bracket for mounting and securing the heat exchanger within the engine compartment of an automobile. For structural strength, mounting brackets are typically attached to or formed integrally with the heat exchanger manifolds. The strength of a mounting bracket and the manner in which the bracket is attached to the heat exchanger is of considerable concern, since failure of the bracket can lead to severe damage to the heat exchanger, with the added potential for the manifold becoming punctured or fractured.

Inlet and outlet fittings are also mounted to one or both manifolds, to which supply and return pipes are connected for transporting fluid to and from the heat exchanger. An alternative to a fitting is an inlet/outlet block, with one block typically being brazed to each manifold. In Japanese patent application 6-229696, an inlet/outlet block is shown as having a machined port that is aligned with an opening formed in the header to which the block is mounted. A sleeve is positioned and brazed within the port and opening so that a leak-free path is provided between the block and header. A threaded bore is provided in the face of the block by which a pipe coupled to the port is secured to the block.

The prior art as described above does not disclose or suggest how a heat exchanger mounting bracket could be modified to also serve the role of an inlet/outlet block, while retaining its ability to reliably mount and secure a heat exchanger within the physically demanding operating environment of an automobile. A particular concern would be that the inlet/outlet port would seriously compromise the integrity of the attachment strength between the mounting bracket and manifold. However, to reduce weight and simplify assembly, it would be desirable if the functions of both a mounting bracket and an inlet/outlet block could be incorporated into a single component.

SUMMARY OF THE INVENTION

It is an object of this invention to provide a heat exchanger equipped with a mounting block that also is configured with an inlet/outlet port through which fluid is transported to and from the heat exchanger.

It is another object of this invention that the mounting block incorporates several features that promote a reliable and secure attachment to the heat exchanger.

It is a further object of this invention that the mounting block includes a sleeve that ensures a leak-free joint between the mounting block and the heat exchanger, and optionally also aids in securing the mounting block to the heat exchanger.

According to the present invention, there is provided a mounting block adapted to be attached to a manifold of an automotive heat exchanger. The mounting block has a flange portion with a surface that preferably engages at least half of the outer perimeter of the manifold. The mounting block is mounted over an opening in the wall of the manifold, and is equipped with an inlet/outlet port that is aligned with the opening so that a flow passage is provided through the manifold block and manifold wall. The mounting block is also adapted to secure the heat exchanger to an automobile.

With the above configuration, the mounting block secures the heat exchanger within the engine compartment of an automobile, and also provides the inlet/outlet port to which a supply/return pipe is attached for transporting a fluid to or from the heat exchanger. The mounting block preferably provides one or more features that promote the integrity of the block-to-manifold joint. In a preferred embodiment, grooves are present in the surface of the flange portion of the mounting block, two of which engage raised portions on the perimeter of the manifold in order to aid in securing the mounting block to the manifold. The remaining grooves provide reservoirs between the mounting block and manifold for braze material that metallurgically joins the mounting block to the manifold. Also included in the preferred embodiment is a sleeve disposed partially within the inlet/outlet port of the mounting block and partially within the opening in the wall of the manifold, so as to provide a leak-free joint between the mounting block and manifold. The sleeve can optionally be configured to assist in securing the mounting block to the manifold.

Assembly of the mounting block to the manifold generally entails engaging the surface of the flange portion of the mounting block with the outer perimeter of the manifold, so that the inlet/outlet port fluidically communicates with the opening in the wall of the manifold. If present, the grooves on the flange portion of the mounting block are engaged with the raised portions on the manifold to assist at least temporarily in securing the block to the manifold. If employed, the sleeve is installed which, if appropriately configured, further serves to secure the block to the manifold. The mounting block is then preferably brazed in place with braze material deposited or otherwise accumulating in the grooves on the flange portion of the block. Simultaneously, the sleeve may be brazed in place within the inlet/outlet port and the opening in the manifold. The mounting block can then be used to mount the heat exchanger to an automobile, after which a supply/return pipe is connected to the inlet/outlet port of the mounting block.

In view of the above, it can be seen that the mounting block of this invention makes possible the combination of a mounting bracket and an inlet/outlet block for both mounting a heat exchanger and attaching supply/return pipes to the heat exchanger with a single component. To promote this capability, the mounting block is preferably equipped with features that structurally enhance the attachment of the block to the manifold, so that the inlet/outlet port does not compromise the integrity of the joint strength between the block and manifold.

Other objects and advantages of this invention will be better appreciated from the following detailed description.

BRIEF DESCRIPTION OF THE DRAWINGS

The present invention will now be described, by way of example, with reference to the accompanying drawings, in which.

DETAILED DESCRIPTION OF THE PREFERRED EMBODIMENT

Figure 1:
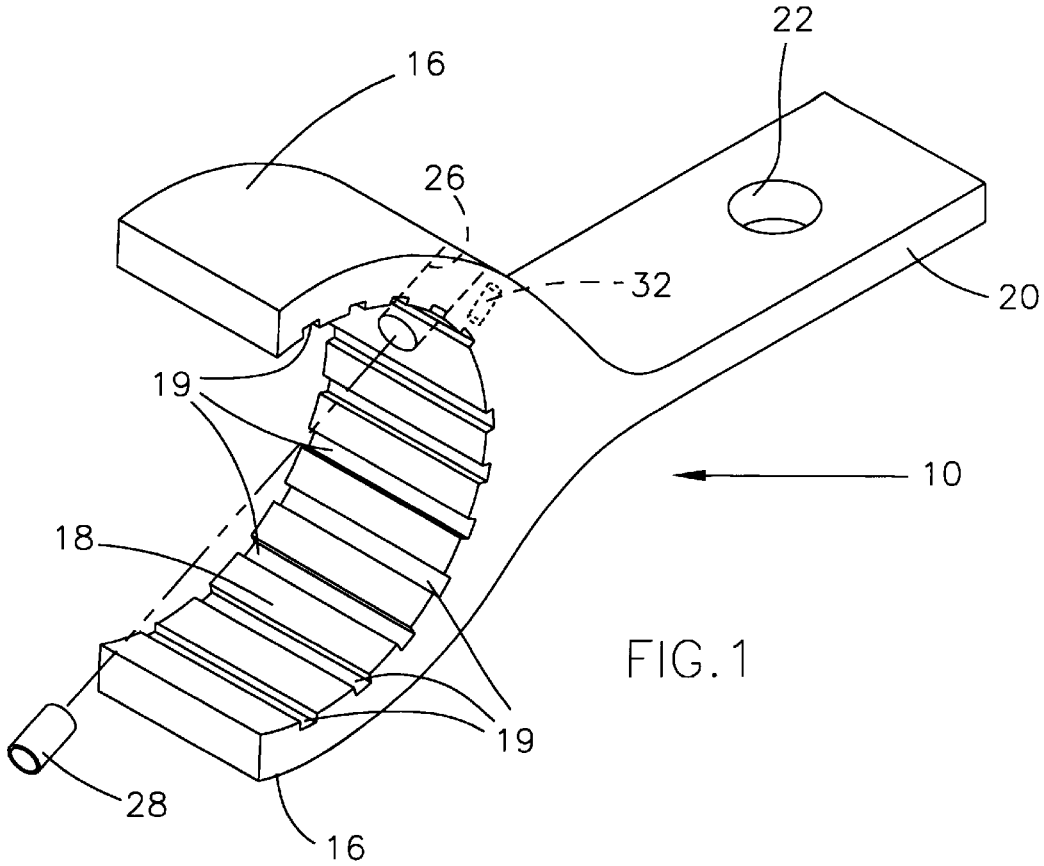
FIG. 1 is a perspective view of a heat exchanger mounting block in accordance with this invention.
Figure 2:
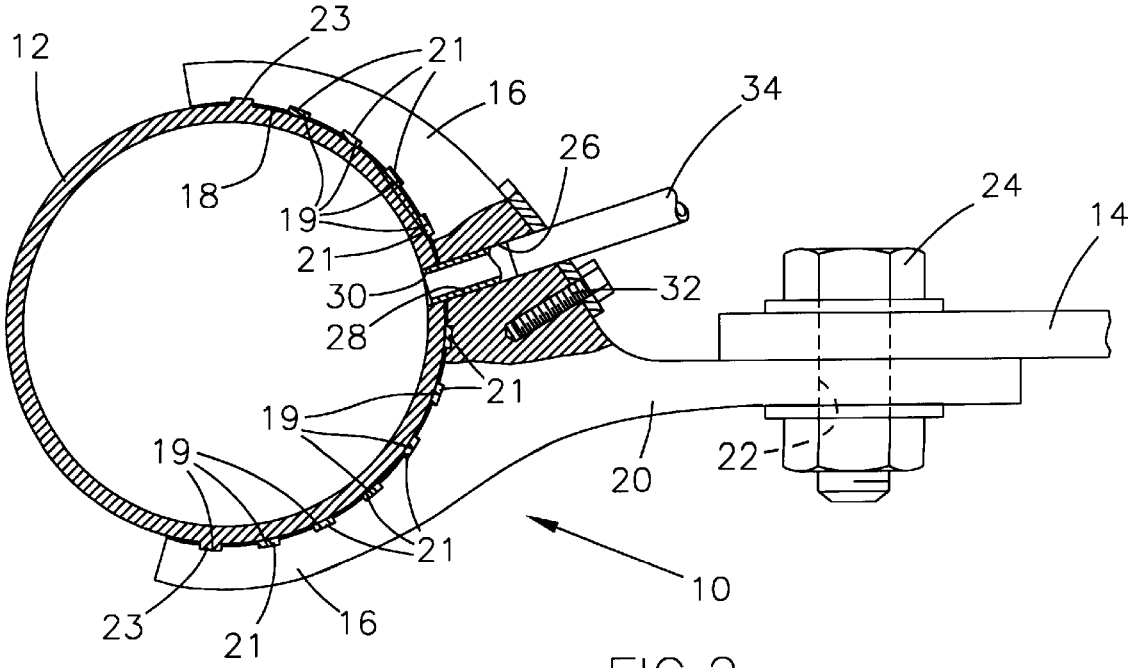
FIG. 2 is a cross-sectional view of the mounting block of FIG. 1 shown mounted to a heat exchanger manifold in accordance with this invention.

Shown in FIGS. 1 and 2 is a mounting block 10 for a heat exchanger unit (not shown). The block 10 is shown in FIG. 2 mounted to a heat exchanger manifold 12. According to this invention, the mounting block 10 has dual functions, one of which is to mount a heat exchanger to the appropriate support structure 14 within the engine compartment of an automobile, as represented in FIG. 2. The second function of the block 10 is to serve as an inlet/outlet block for fluid flow to and from the heat exchanger. While a particular configuration is shown for the block 10 in the drawings, and the block 10 is described for installation in an automobile, those skilled in the art will appreciate that other block configurations and other applications, including those outside the automotive industry, are possible with this invention.

The block 10 includes a pair of flanges or tabs 16 having a semicircular shape and defining a concave surface 18. As shown in FIG. 2, the surface 18 is shaped to be mated with the circular outer perimeter of the manifold 12. As also seen from FIG. 2, the surface 18 preferably contacts about half of the perimeter of the manifold 12, and preferably more than half of the perimeter in order to effectively block the block 10 onto the manifold 12. For this reason, the cross-section of the tabs 16 is preferably tailored to provide adequate flexibility to allow the tabs 16 to expand around the manifold 12 during assembly of the block 10 onto the manifold 12. The block 10 further includes a mounting flange 20 having a mounting hole 22, through which a bolt 24 is inserted for attaching the block 10 to the automobile support structure 14 as shown in FIG. 2. In view of the above structural requirements, a preferred material for the block 10 is an aluminum alloy, though it is foreseeable that other materials could be used.

Formed in the surface 18 of the tabs 16 are a number of grooves 19 that are generally oriented parallel to the axis of the concave surface 18. As seen in FIG. 2, the grooves 19 accommodate a braze material 21 for metallurgically joining the block 10 to the manifold 12. The braze material 21 can be deposited as a paste in the grooves 19, or the braze material 21 can originally be present as a cladding on the block 10 or manifold 12 and thereafter accumulate in the grooves 19 during the brazing operation. Notably, the grooves 19 facilitate the escape and removal of a brazing flux during the brazing operation. FIG. 2 also shows the manifold 12 as including a pair or raised portions, shown as an oppositely-disposed pair of seams 23. Two of the grooves 19 are engaged with the seams 23 in order to more securely mount the block 10 to the manifold 12 prior to the brazing operation.

Shown extending through the block 10 is an inlet/outlet port 26. As seen in FIG. 2, the port 26 is aligned with an opening 30 in the wall of the manifold 12, and a sleeve 28 is installed in the passage formed by the aligned port 26 and opening 30. The sleeve 28 shown in FIGS. 1 and 2 is intended to be brazed in place in order to form a leak-proof joint between the block 10 and manifold 12. For this reason, preferred coating materials for the sleeve 28 are aluminum clad alloys such as AA4343, AA4045 and AA4047. A threaded bore 32 is located adjacent the inlet/outlet port 26 in order to secure a supply/return pipe 34 coupled to the port 26.

With the above construction, the mounting block 10 of this invention incorporates a number of different features that cooperate to secure the block 10 to the manifold 12 in a manner that promotes the structural integrity of the block-to-manifold joint, so that the joint remains fluid-tight over numerous thermal and pressure cycles. When initially mounted to the manifold 12, the tabs 16 of the block 10 serve to grip the perimeter of the manifold 12, so that the amount of movement possible between the block 10 and manifold 12 is drastically reduced. The initial attachment of the block 10 to the manifold 12 is further promoted by the engagement of the seams 23 on the manifold 12 with the two grooves 19 on the concave surface 18 of the tabs 16. The remaining grooves 19 provide sites for braze material 21 that permanently joins the block 10 to the manifold 12. Finally, the sleeve 28 provides a level of additional reinforcement within the flow path formed by the inlet/outlet port 26 and the opening 30 in the manifold 12.

Figure 3:
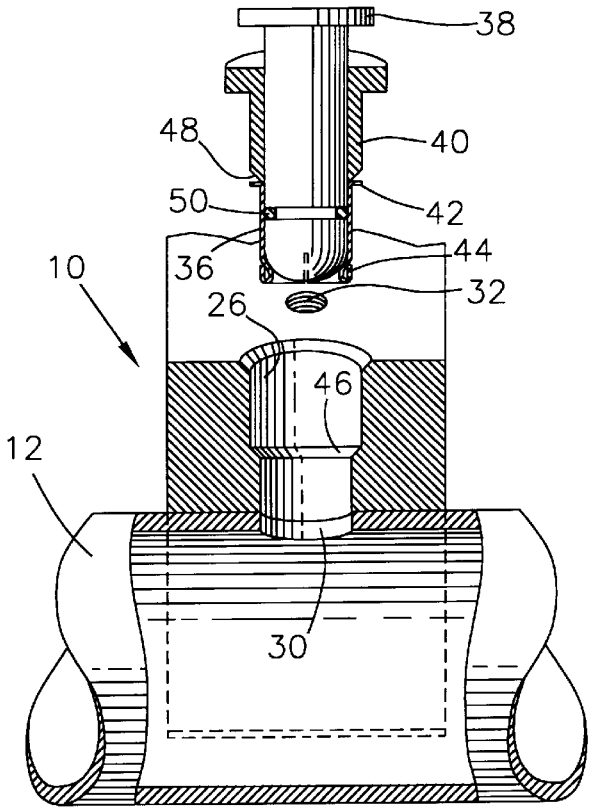
FIGS. 3 through 6 illustrate steps for installing a sleeve within the mounting block and manifold in accordance with an optional embodiment of this invention.

In accordance with an optional feature of this invention, a modified sleeve 36 shown in FIGS. 3 through 6 can be employed to further promote the structural integrity of the block-to-manifold joint. In FIG. 3, the sleeve 36 is shown as being mounted on a pin 38 that is slidably received in a collet 40. An o-ring 50 serves to retain the sleeve 36 on the pin 38 prior to installing the sleeve 36 in the inlet/outlet port 26 of the block 10. The sleeve 36 is shown as having an annular flange 42 at its upper end and a rim 44 at its lower end. The annular flange 42 can be generally described as extending radially outward from the tube-shaped body of the sleeve 36, while the rim 44 is formed by an outwardly-rolled portion of the sleeve 36 that includes an approximately 180° bend, as shown in FIG. 3. According to this feature of the invention, the annular flange 42 is intended to engage and be elastically deformed against a tapered shoulder 46 within the inlet/outlet port 26 of the mounting block 10, while the rim 44 engages and is elastically deformed against the interior wall surface of the manifold 12. The elastic deformation of the flange 42 and rim 44 creates a tensile load on the sleeve 36 that aids in securing the mounting block 10 to the manifold 12.

Figure 4:
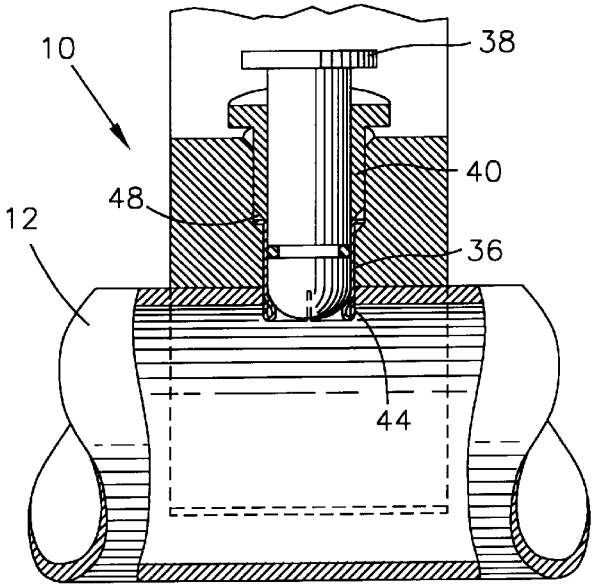
Figure 5:
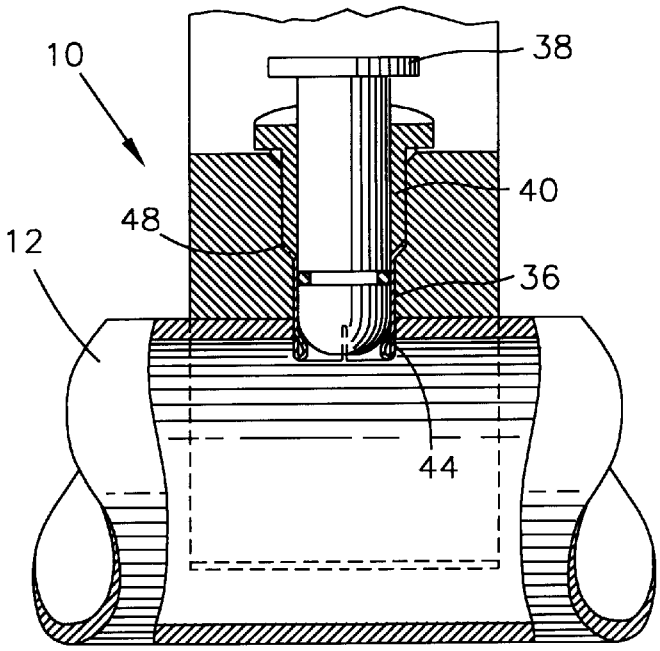
Figure 6:
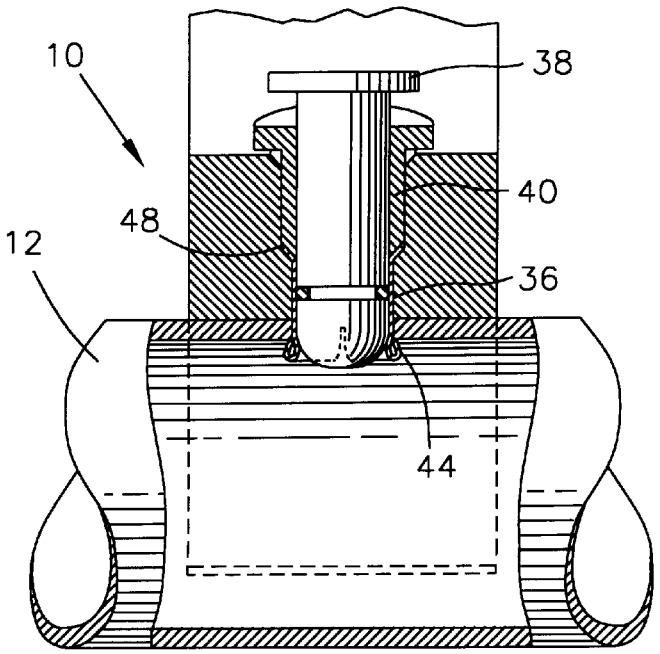

In FIG. 4, the pin 38 is shown as having positioned the sleeve 36 within the port 26 until the annular flange 42 makes contact with the tapered shoulder 46 within the port 26. In FIG. 5, a chamfered leading edge 48 of the collet 40 is shown as forcing the sleeve 36 further downward into the port 26, with the result that the annular flange 42 is elastically deformed to a degree sufficient to position the rim 44 of the sleeve 36 adjacent the interior wall surface of the manifold 12. Thereafter, and as portrayed in FIG. 6, the pin 38 is forced downward relative to the collet 40, such that the rim 44 is expanded radially outwardly and into engagement with the interior wall surface of the manifold 12. Upon removal of the pin 38 and collet 40, the annular flange 42 and rim 44 will seek but be prevented from regaining their original undeformed shape shown in FIG. 3, thereby generating the desired tensile load on the sleeve 36 that aids in securing the mounting block 10 to the manifold 12.

While the invention has been described in terms of a preferred embodiment, it is apparent that other forms could be adopted by one skilled in the art. Accordingly, the scope of the invention is to be limited only by the following claims.

What is claimed is:

1. A heat exchanger for an automobile, the heat exchanger comprising:

a manifold having a wall defining an internal passage within the manifold and an outer perimeter of the manifold, the manifold having a pair of raised portions on the outer perimeter thereof;

an opening through the wall of the manifold; and a mounting block attached to the manifold and over the opening in the wall of the manifold, the mounting block comprising:

a flange portion having a surface that engages at least about half of the outer perimeter of the manifold, the flange portion having grooves in the surface thereof, the raised portions of the manifold being engaged by at least two of the grooves so as to secure the mounting block to the manifold;

a second portion adapted to secure the heat exchanger to an automobile;

an inlet/outlet port extending through the flange portion of the mounting block and in fluidic communication with the opening in the wall of the manifold; and means on the mounting block for securing a supply/return pipe to the inlet/outlet port of the mounting block.

2. A heat exchanger as recited in claim 1, further comprising braze material disposed within at least some of the grooves between the manifold and the flange portion of the mounting block, the braze material metallurgically joining the mounting block to the manifold.

3. A heat exchanger as recited in claim 1, wherein the second portion comprises a mounting flange extending away from the flange portion of the mounting block and a mounting hole extending through the mounting flange.

4. A heat exchanger for an automobile, the heat exchanger comprising:

a manifold having a wall defining an internal passage within the manifold and an outer perimeter of the manifold;

an opening through the wall of the manifold;

a mounting block attached to the manifold and over the opening in the wall of the manifold, the mounting block comprising:

a flange portion having a surface that engages at least about half of the outer perimeter of the manifold;

a second portion adapted to secure the heat exchanger to an automobile;

an inlet/outlet port extending through the flange portion of the mounting block and in fluidic communication with the opening in the wall of the manifold; and means on the mounting block for securing a supply/return pipe to the inlet/outlet port of the mounting block; and a sleeve disposed partially within the inlet/outlet port of the mounting block and partially within the opening in the wall of the manifold, the sleeve comprising a radially-outward extending annular flange engaging the inlet/outlet port of the mounting block and a rim engaging the wall of the manifold so as to induce a tensile load on the sleeve that assists in securing the mounting block to the manifold.

5. A heat exchanger as recited in claim 4, wherein the inlet/outlet port of the mounting block has an internal tapered shoulder and the annular flange of the sleeve is elastically deformed against the internal tapered shoulder.

6. A heat exchanger as recited in claim 4, wherein the rim of the sleeve comprises an outwardly-rolled portion of the sleeve with an approximately 180° bend therein.

7. A heat exchanger for an automobile, the heat exchanger comprising:

a manifold having a wall defining an internal passage within the manifold and an outer perimeter of the manifold;

an opening through the wall of the manifold; and a mounting block attached to the manifold and over the opening in the wall of the manifold, the mounting block comprising:

a flange portion having a surface that engages at least about half of the outer perimeter of the manifold, the flange portion comprising a pair of tabs that engage opposing portions of the outer perimeter of the manifold;

a second portion adapted to secure the heat exchanger to an automobile, the second portion being an integral flange portion of the mounting block that extends away from the tabs of the flange portion;

an inlet/outlet port extending through the flange portion of the mounting block and in fluidic communication with the opening in the wall of the manifold, the inlet/outlet port being axially aligned through one of the pair of tabs with the opening in the wall of the manifold; and means on the mounting block for securing a supply/return pipe to the inlet/outlet port of the mounting block.

8. A heat exchanger installed in an automobile, the heat exchanger comprising:

a manifold having a wall defining an internal passage within the manifold and an outer perimeter of the manifold, the manifold having a pair of oppositely-disposed raised surface features on the outer perimeter thereof;

an opening through the wall of the manifold;

a mounting block attached to the manifold and over the opening in the wall of the manifold, the mounting block comprising a flange portion having a surface that engages more than half of the outer perimeter of the manifold, the flange portion having grooves in the surface thereof, two of the grooves engaging the raised surface features on the manifold so as to secure the mounting block to the manifold;

a mounting flange extending from the mounting block and a mounting hole extending through the mounting flange;

a fastener within the mounting hole and securing the mounting flange to the automobile;

an inlet/outlet port extending through the mounting block and in fluidic communication with the opening in the wall of the manifold;

a supply/return pipe secured to the inlet/outlet port of the mounting block; and a sleeve disposed partially within the inlet/outlet port of the mounting block and partially within the opening in the wall of the manifold.

9. A heat exchanger as recited in claim 8, further comprising braze material disposed within at least some of the grooves between the manifold and the flange portion of the mounting block, the braze material metallurgically joining the mounting block to the manifold.

* * * * *